US011205551B2

(12) United States Patent
Mikl et al.

(10) Patent No.: US 11,205,551 B2
(45) Date of Patent: Dec. 21, 2021

(54) CRADLE FOR A NARROW RELAY, CRADLE ASSEMBLY AND RELAY

(71) Applicant: Tyco Electronics Austria GmbH, Vienna (AT)

(72) Inventors: Rudolf Mikl, Maria Ellend (AT); Markus Gutmann, Brand (AT)

(73) Assignee: Tyco Electronics Austria GmbH, Vienna (AT)

( * ) Notice: Subject to any disclaimer, the term of this patent is extended or adjusted under 35 U.S.C. 154(b) by 121 days.

(21) Appl. No.: 16/043,545

(22) Filed: Jul. 24, 2018

(65) Prior Publication Data

US 2018/0330905 A1 Nov. 15, 2018

Related U.S. Application Data

(63) Continuation of application No. PCT/EP2017/051795, filed on Jan. 27, 2017.

(30) Foreign Application Priority Data

Jan. 29, 2016 (DE) ..... 10 2016 201 409.9

(51) Int. Cl.

| | |
|---|---|
| ***H01H 50/64*** | (2006.01) |
| ***H01H 50/02*** | (2006.01) |
| ***H01H 50/24*** | (2006.01) |
| ***H01H 50/04*** | (2006.01) |

(52) U.S. Cl.

CPC ..... *H01H 50/026* (2013.01); *H01H 50/041* (2013.01); *H01H 50/043* (2013.01); *H01H 50/24* (2013.01); *H01H 50/64* (2013.01); *H01H 50/641* (2013.01); *H01H 50/648* (2013.01); *H01H 2050/028* (2013.01)

(58) Field of Classification Search

CPC ..... H01H 50/24; H01H 50/026; H01H 2050/028; H01H 50/041; H01H 50/043; H01H 50/64; H01H 50/641; H01H 50/648

See application file for complete search history.

(56) References Cited

U.S. PATENT DOCUMENTS

| | | | |
|---|---|---|---|
| 5,243,312 | A | 9/1993 | Schedele |
| 5,250,919 | A | 10/1993 | Schedele |

FOREIGN PATENT DOCUMENTS

| | | | |
|---|---|---|---|
| CN | 201066662 | Y | 5/2008 |
| CN | 201812758 | U | 4/2011 |
| CN | 201985036 | U | 9/2011 |
| GB | 2193041 | A | 1/1988 |
| JP | 175444 | U | 5/1989 |

(Continued)

OTHER PUBLICATIONS

English translation of Japanese Notice of Reasons for Refusal, dated Sep. 3, 2019, 7 pages.

(Continued)

*Primary Examiner* — Ramon M Barrera
(74) *Attorney, Agent, or Firm* — Barley Snyder

(57) ABSTRACT

A cradle for a relay comprises a force introduction section at which a force is introduced from a triggering system and a force diversion section in which the force that is introduced from the triggering system is diverted to a contact system. A direct connection line extending between the force introduction section and the force diversion section runs through a receptacle. A bottom of the receptacle is spaced apart from the direct connection line.

19 Claims, 15 Drawing Sheets

(56) References Cited

FOREIGN PATENT DOCUMENTS

| | | | |
|---|---|---|---|
| JP | 3-13651 | U | 2/1991 |
| JP | H05504863 | A | 7/1993 |
| JP | 2013218888 | A | 10/2013 |
| WO | 9107769 | A1 | 5/1991 |

OTHER PUBLICATIONS

Abstract of JP 2013218888, dated Oct. 24, 2013, 1 page.
English machine translation of JP03-013651, dated Feb. 12, 1991, 5 pages.
PCT Notification, The International Search Report and The Written Opinion of the International Searching Authority, dated May 8, 2017, 13 pages.
Chinese First Office Action and English translation, App. No. 2017800084757, dated Apr. 2, 2019, 14 pages.
Japanese Decision of Refusal and English translation, dated Apr. 28, 2020, 16 pages.
European Patent Office communication, dated Feb. 16, 2021, 10 pages.
Abstract of CN 201066662, dated May 28, 2008, 1 page.

CRADLE FOR A NARROW RELAY, CRADLE ASSEMBLY AND RELAY

CROSS-REFERENCE TO RELATED APPLICATIONS

This application is a continuation of PCT International Application No. PCT/EP2017/051795, filed on Jan. 27, 2017, which claims priority under 35 U.S.C. § 119 to German Patent Application No. 102016201409.9, filed on Jan. 29, 2016.

FIELD OF THE INVENTION

The present invention relates to an electrical relay and, more particularly, to a cradle for an electrical relay.

BACKGROUND

A cradle is used in an electrical relay to transmit a force from a triggering system of a first circuit, typically an electromagnetic system with an armature, to a contact system of a second circuit. In order to realize sufficient creepage and air gaps in previous systems, large spacings exist between the triggering system and the contact system, and materials with special properties, in particular with high capacity to carry creepage current, are used. These previous systems, consequently, require a lot of space and use expensive materials.

SUMMARY

A cradle for a relay comprises a force introduction section at which a force is introduced from a triggering system and a force diversion section in which the force that is introduced from the triggering system is diverted to a contact system. A direct connection line extending between the force introduction section and the force diversion section runs through a receptacle. A bottom of the receptacle is spaced apart from the direct connection line.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
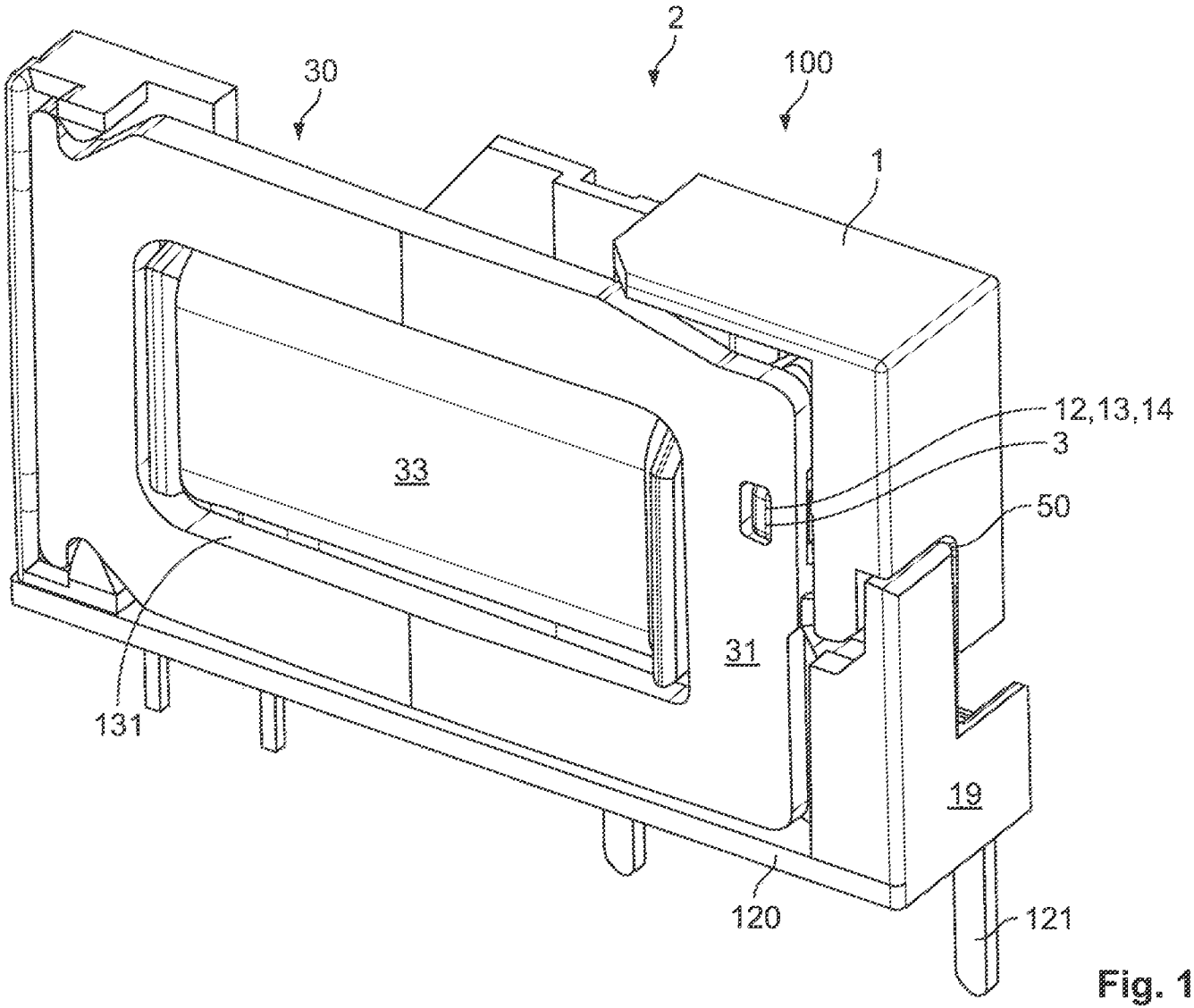
FIG. 1 is a perspective view of a relay including a cradle according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A cradle 1 according to an embodiment of the invention is shown in FIGS. 1-6 and 10-16. The cradle 1 comprises a force introduction section 3 and a force diversion section 4. The force introduction section 3 and the force diversion section 4 each form a leg 9, as shown in FIGS. 2, 3, 5, and 6. In the shown embodiment, the leg 9 of the force introduction section 3 is shorter than the leg 9 of the force diversion section 4. By varying the length of the legs 9 and the lever force which results from this, it is possible to adjust a transmission ratio between the force introduction section 3 and the force diversion section 4. In an embodiment, the cradle 1 is an injection-molded member manufactured from a plastic material.

Figure 2:
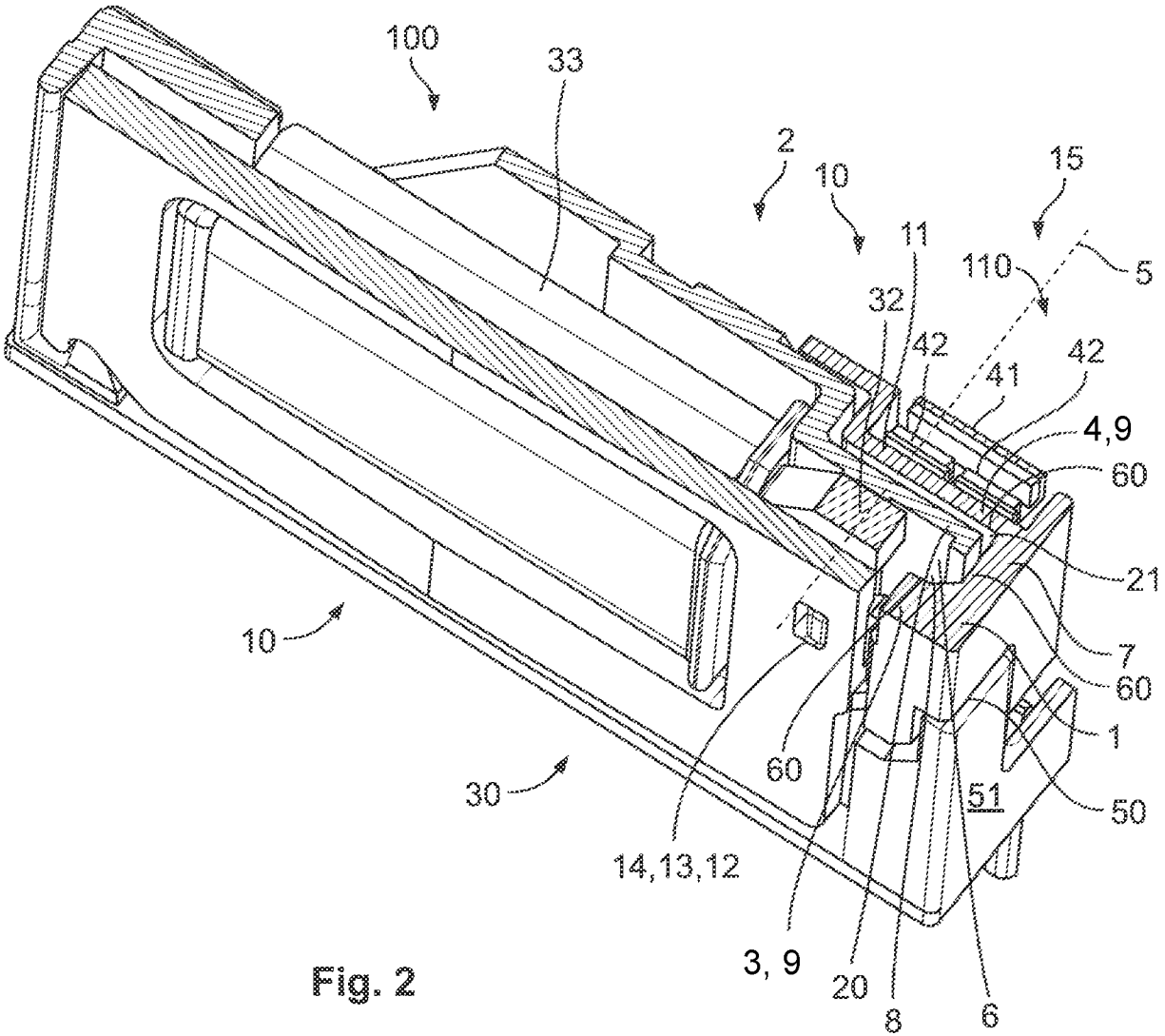
FIG. 2 is a sectional perspective view of the relay.
Figure 3:
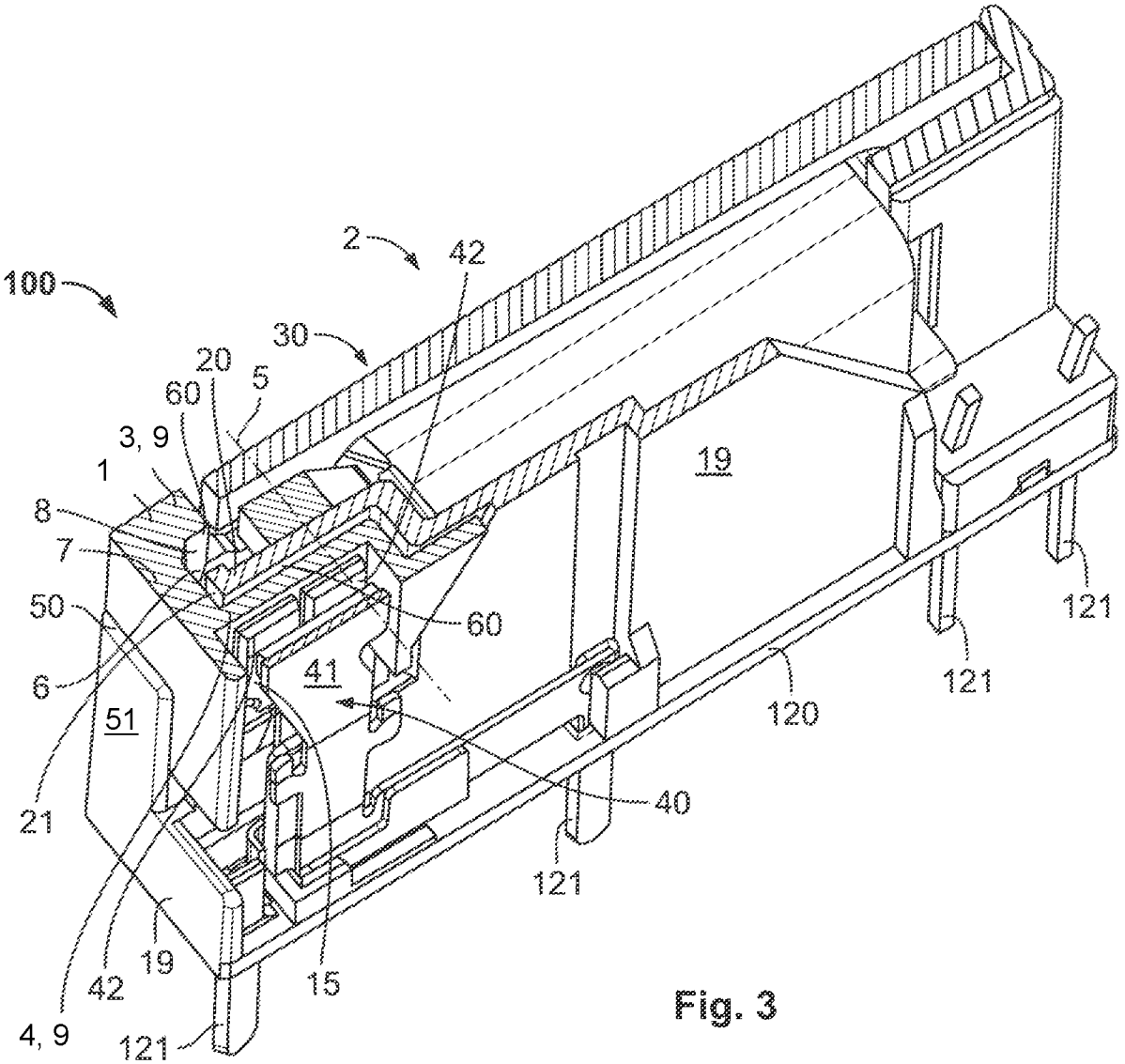
FIG. 3 is a sectional perspective view of the relay.

A direct connection line 5 between the force introduction section 3 and the force diversion section 4 runs through a receptacle 6 of the cradle 1, as shown in FIGS. 2 and 3. A bottom 7 of the receptacle 6 is spaced apart from the direct connection line 5. The bottom 7 of the receptacle 6 is bordered by the two legs 9. A pair of inner walls 60 of the receptacle 6 extend in a U-shape 80 shown in FIG. 6 and form a part of the creepage gap which must be overcome for a creepage current. The U-shape 80 opens perpendicularly to the direct connection line 5 between the force introduction section 3 and the force diversion section 4.

Figure 6:
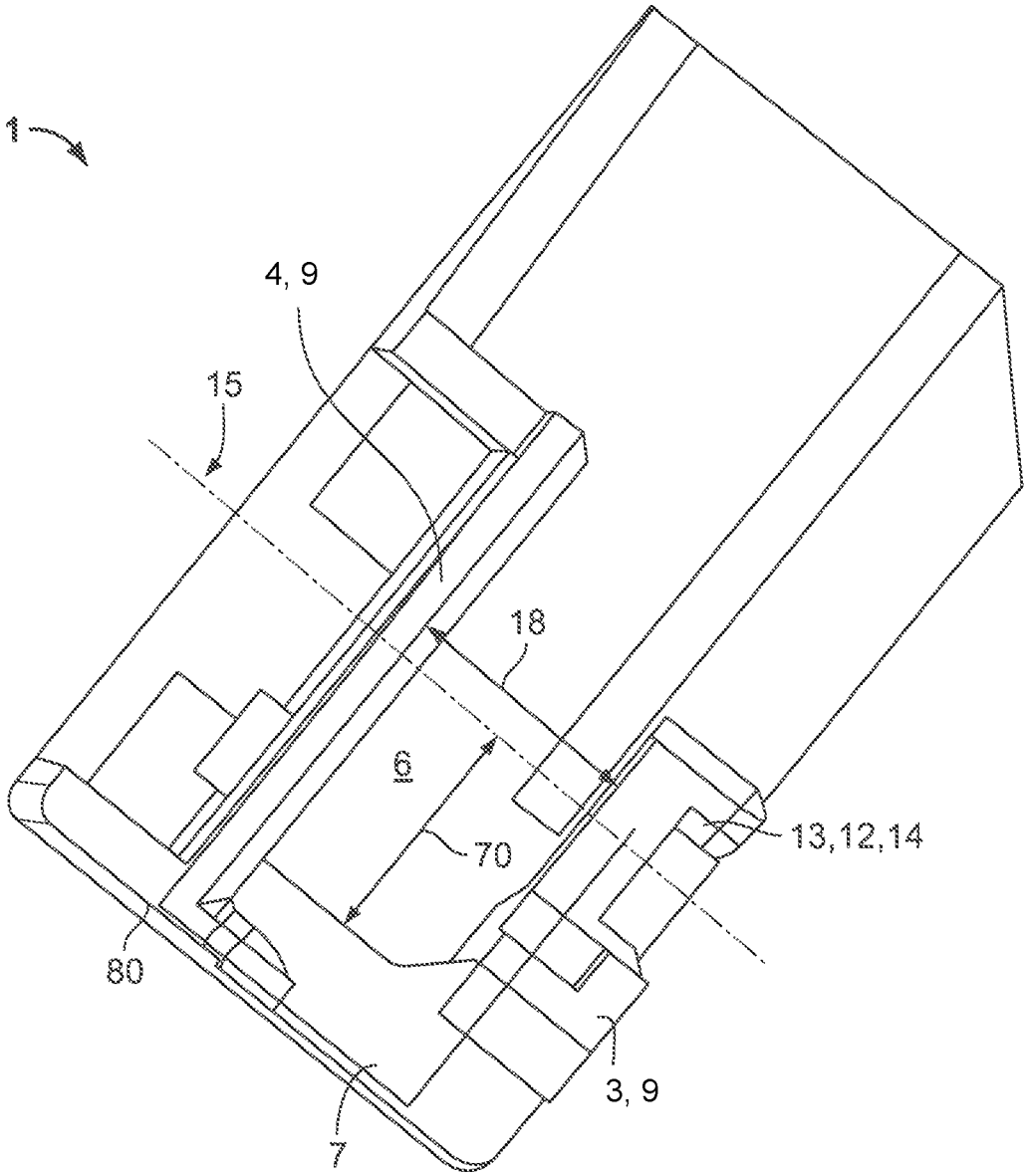
FIG. 6 is a perspective view of the cradle.
Figure 7:
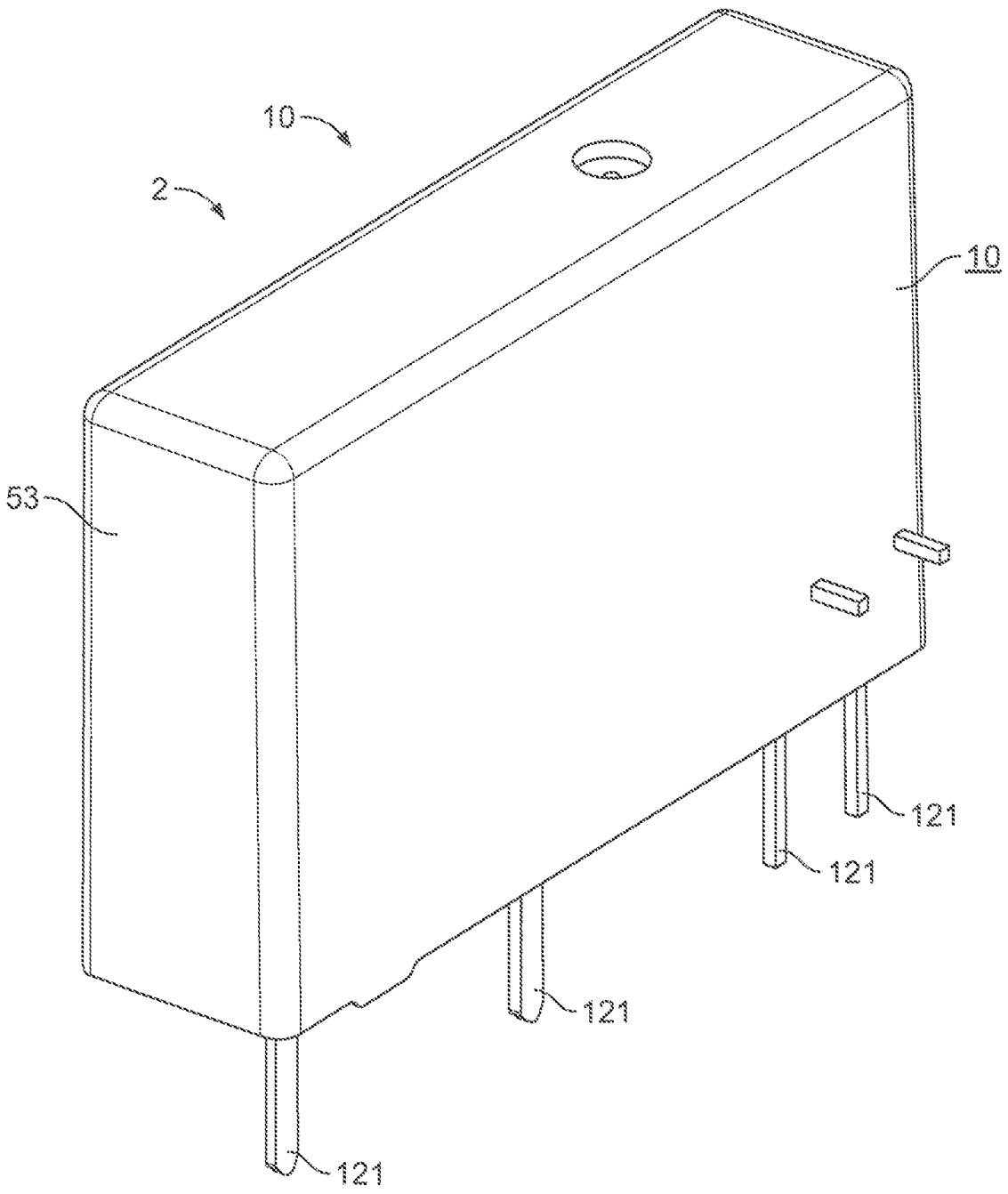
FIG. 7 is a perspective view of the relay with a cover.
Figure 8:
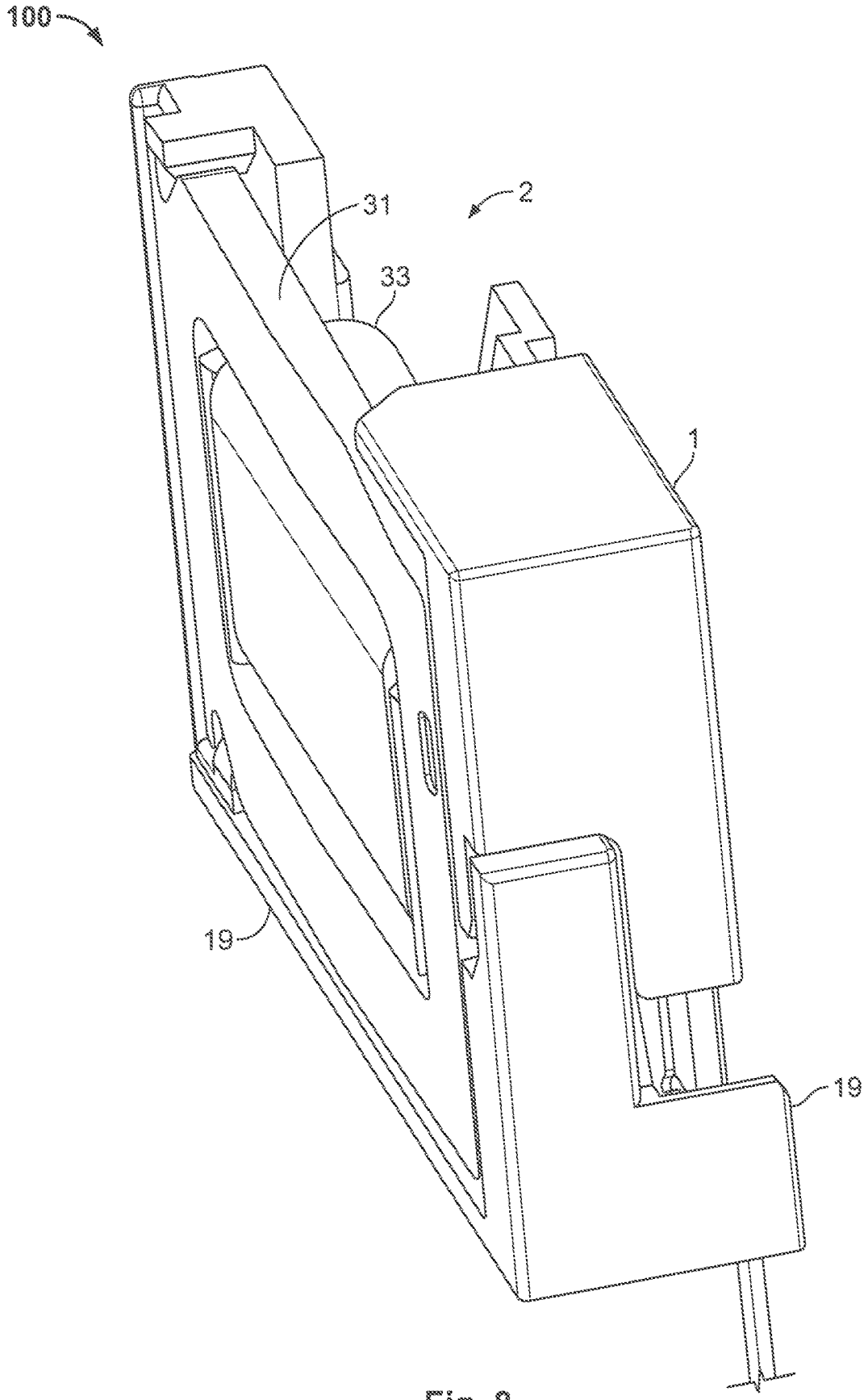
FIG. 8 is a perspective view of the relay.
Figure 9:
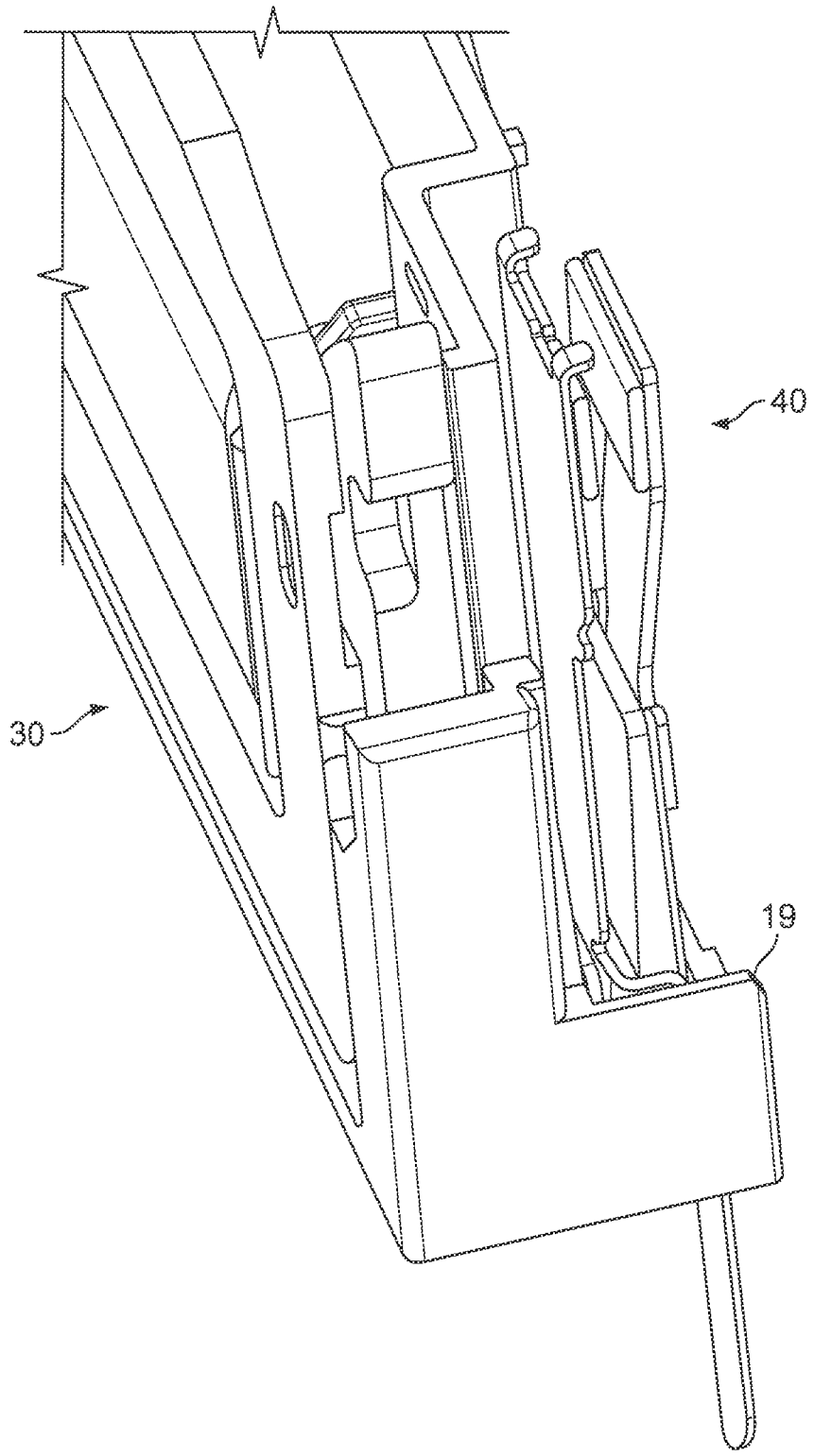
FIG. 9 is a perspective view of the relay without the cradle.
Figure 10:
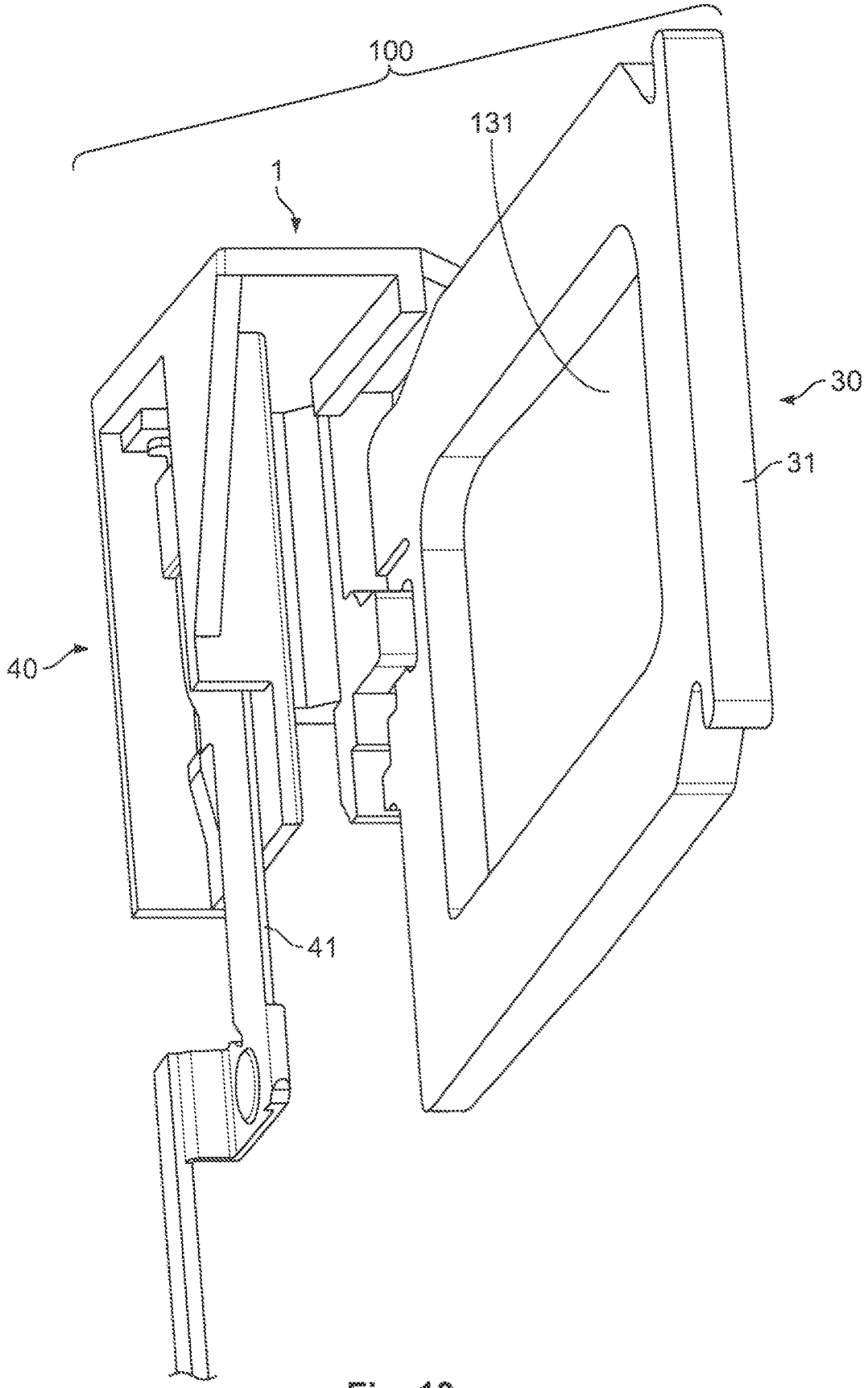
FIG. 10 is a perspective view of a cradle assembly with the cradle, an armature, and a spring.

Due to the spacing apart of the receptacle 6 from the direct connection line 5, the creepage gap between the force introduction section 3 and the force diversion section 4 is lengthened compared to a direct connection. A spacing 70 between the bottom 7 and the direct connection line 5, as shown in FIG. 6, is larger than a thickness 18 measured along the direct connection line 5.

A relay 2 according to an embodiment is shown in FIGS. 1-3 and 7-9. The relay 2 includes the cradle 1, a triggering system 30, and a contact system 40. In an embodiment, the relay 2 is a narrow relay. In an embodiment shown in FIG. 7, the relay 2 is disposed in a cover 53.

As shown in FIGS. 1-3, the triggering system 30 comprises an electromagnet 33 through which a triggering current flows, a yoke 32 which runs through the electromagnet 33 and concentrates the magnetic field which is generated by the electromagnet 33, and an armature 31 which is arranged in the relay 2. The armature 31 is hinged and consists of a ferromagnetic material. The armature 31 is attracted by the yoke 32 when a triggering current of sufficient strength is flowing. The movement produced as a result is intended to be transmitted to the contact system 40 which is part of an electrical circuit which is to be switched. The contact system 40, as shown in FIGS. 2 and 3, includes contact members 42 which are pressed against a spring 41 when the triggering system 30 triggers.

As shown in FIG. 1, the force introduction section 3 lies against the armature 31 and is connected to it; the force diversion section 4 lies against the part of the contact system 40 which comprises the contact members 42. If there is an additional member in the receptacle 6, for example a section 20 of a base body 19, the air gap between the force introduction section 3 and the force diversion section 4 is lengthened correspondingly, lengthening a creepage gap between the force introduction section 3 and the force diversion section 4. The relay 2 can be particularly narrow, because due to the receptacle 6 there is sufficient isolation with long creepage and air gaps despite a short distance between the force introduction section 3 and the force diversion section 4.

A cradle assembly 100 shown in FIGS. 1-3 comprises, alongside the cradle 1, the armature 31, which lies against the force introduction section 3 and is connected to it, and a part of the contact system 40 which comprises the contacts 42 which lies against the force diversion section 4.

The relay 2 is narrow and nevertheless has sufficient isolation between the triggering system 30 and the contact system 40. As shown in FIG. 3, an isolation slot 21 of the relay 2, which extends in a U-shape, is formed by the receptacle 6 and the section 20 of the base body 19 arranged therein. The legs 9 run parallel to longitudinal sides 10 of the relay 2 as shown in FIG. 2. A wall 11 of the receptacle 6, as shown in FIG. 2, extends perpendicular to the direct connection line 5 and thus shields the contact system 40 from the triggering system 30. In order to enable a particularly compact configuration, the armature 31 has a recess 131 shown in FIG. 1 in which at least part of the electromagnet 33 is arranged.

As shown in FIGS. 2, 3, 5 and 6, an inner thickness 18 of the receptacle 6 measured along the direct connection line 5 is smaller than an inner width 17 measured perpendicular thereto and a depth 16 of the receptacle 6 also measured perpendicular thereto. As a result, a particularly long path is obtained between the triggering system 30 and the contact system 40. The receptacle 6 forms, at least in sections, a channel 8 shown in FIGS. 2 and 3 in which the section 20 of the base body 19 is received. The receptacle 6 is therefore channel-shaped, as a result of which it is possible to compensate, for example, for manufacturing tolerances. The channel 8 is simple to manufacture.

The base body 19 receives the triggering system 30 and the contact system 40 as shown in FIGS. 2 and 3. The base body 19 forms a frame of the relay 2. The base body 19 includes a base plate 120 and contact members 121 which protrude out from it and which are connected to the triggering system 30 or contact system 40.

As shown in FIGS. 1, 2, 5, and 6, an engagement section 12, in the form of a hook 13, is attached to the leg 9 of the force introduction section 3. The hook 13 also acts as an engagement projection 14 which projects parallel to a longitudinal side 10 of the relay 2, as a result of which the relay 2 is particularly compact. The hook 13 engages in the triggering system 30, in particular in a hole in the armature 31 as shown in FIG. 1. The wall 11 of the receptacle 6 is configured with the engagement projection 14 for the triggering system 30.

The cradle 1 forms a contact system receptacle 15 in which the two contact elements 42 are arranged, as shown in FIGS. 2-4, 12-14, and 16. The contact system receptacle 15 shown is configured in a U-shaped, shield-shaped or tub-shaped manner, so that the contact members 42 are also shielded at the sides. The shield formed by the contact system receptacle 15 extends around the contact members 42. The leg 9 which lies against the force diversion section 4 continues in part beyond the contact system receptacle 15 in order to further lengthen the creepage and air gap.

The force introduction section 3 is at least in part arranged between the armature 33 and the yoke 32, as shown in FIGS. 2 and 3. As a result, the relay 1 can be particularly narrow. In this case, the yoke 32 serves as a stop for a movement of the cradle 1.

Figure 4:
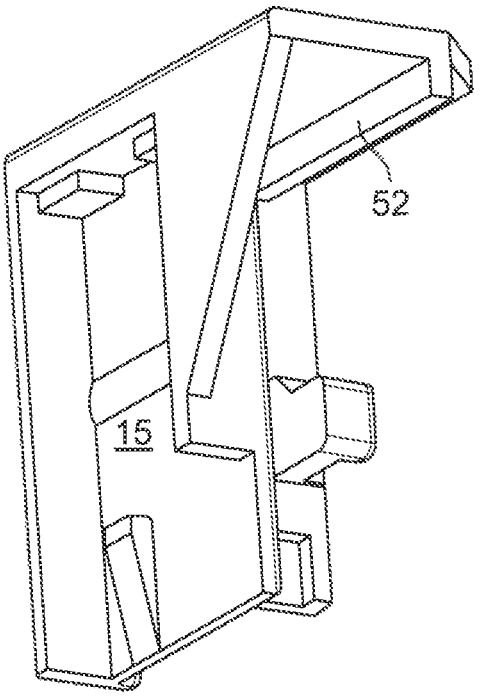
FIG. 4 is a perspective view of the cradle.
Figure 5:
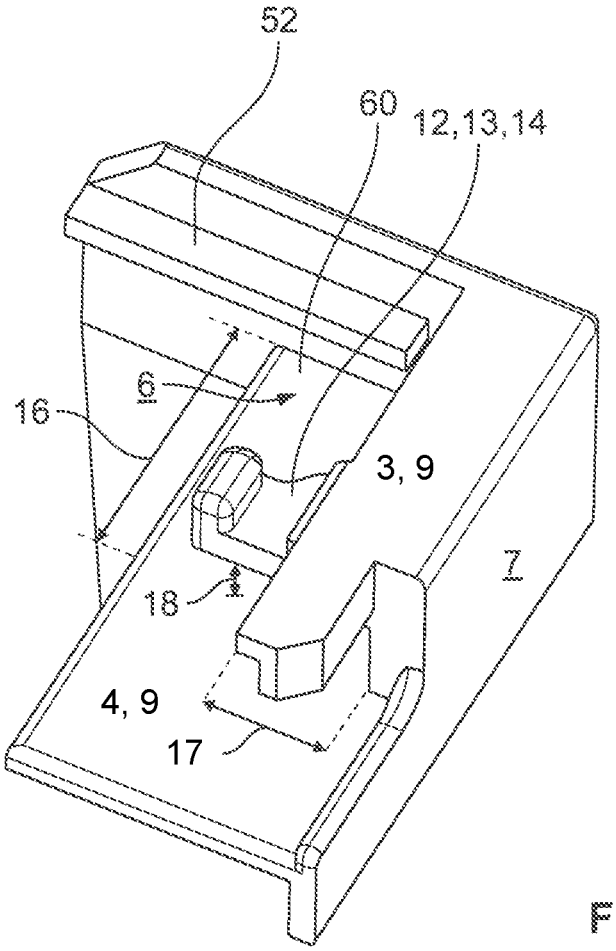
FIG. 5 is a perspective view of the cradle.
Figure 11:
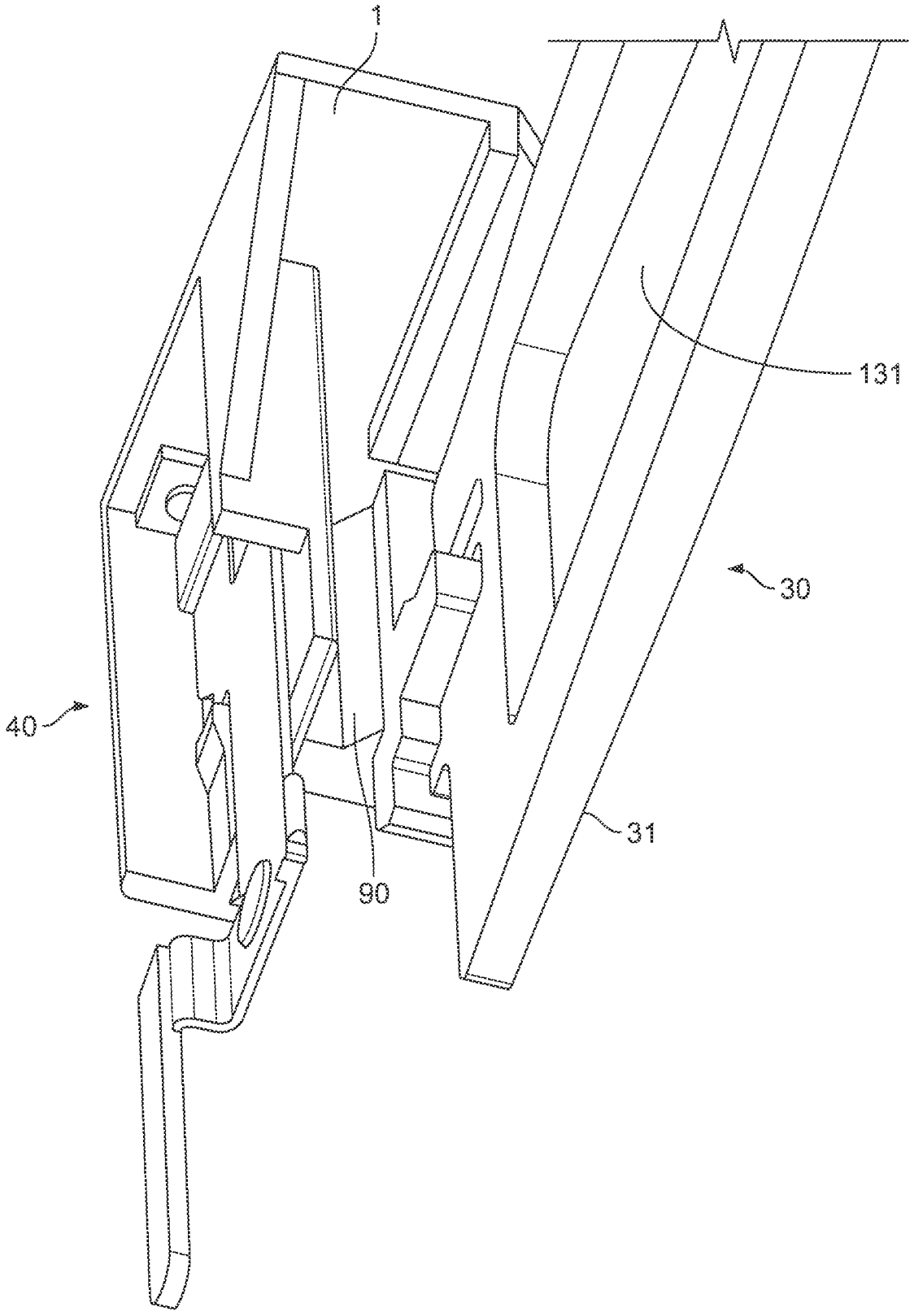
FIG. 11 is a perspective view of the cradle with the armature and the spring.
Figure 12:
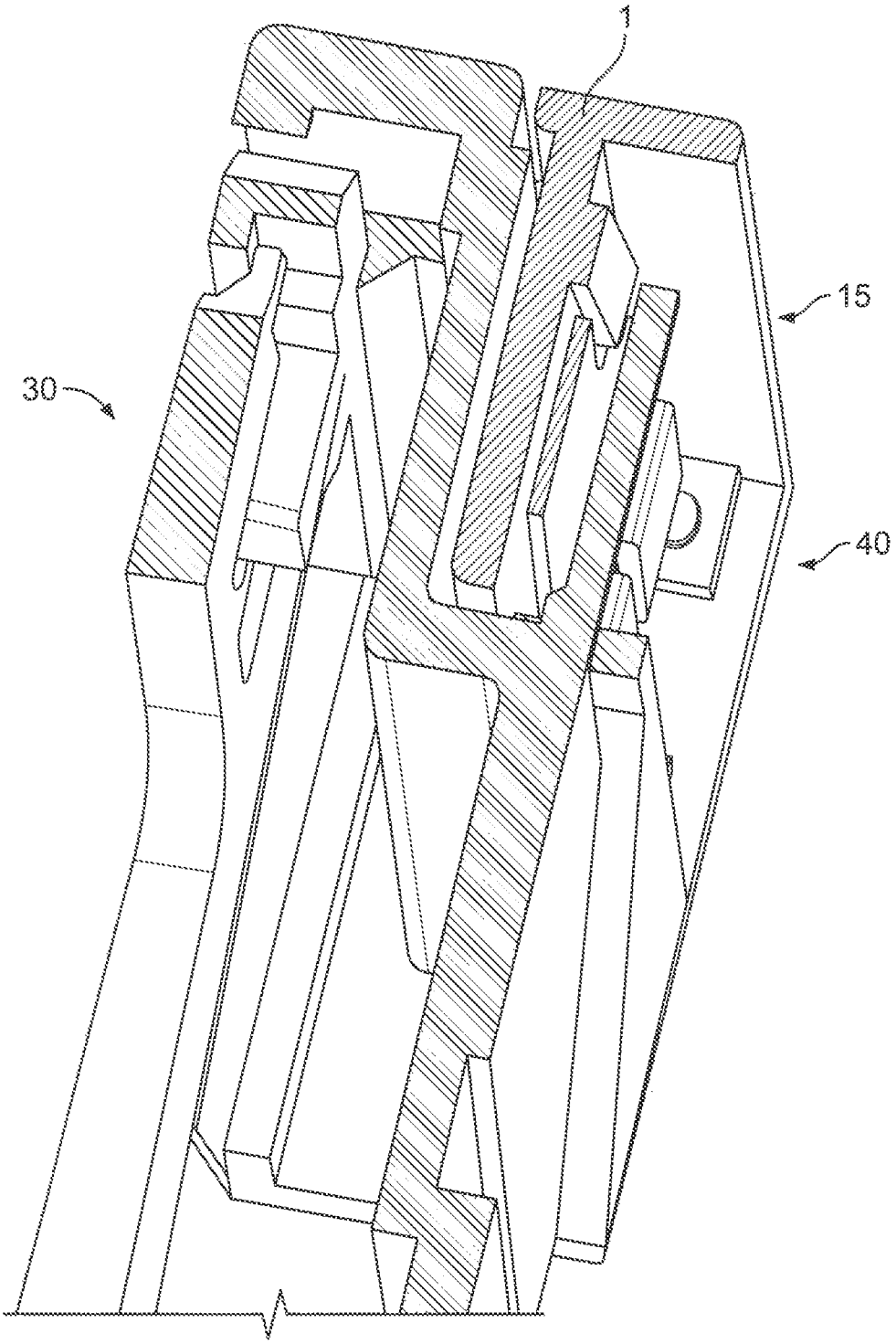
FIG. 12 is a sectional perspective view of the relay.
Figure 13:
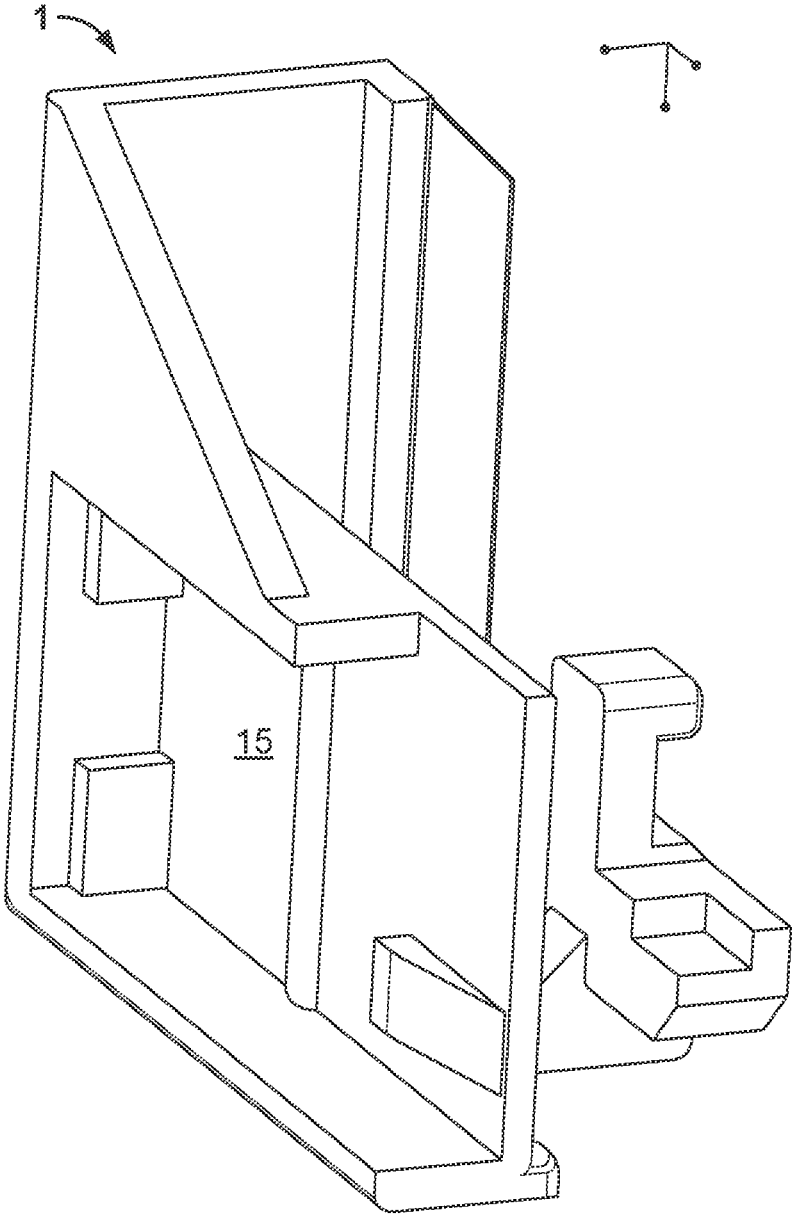
FIG. 13 is a perspective view of the cradle.
Figure 14:
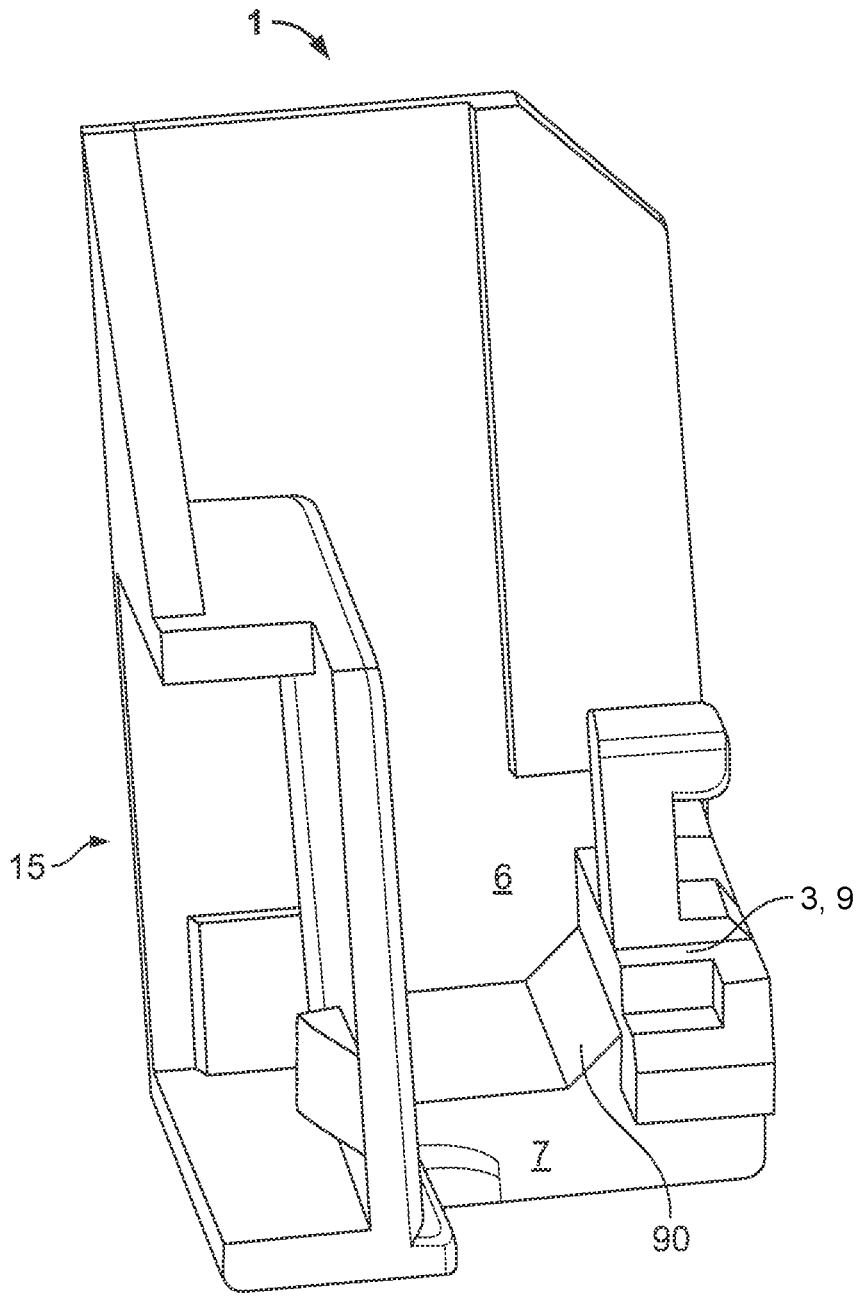
FIG. 14 is a perspective view of the cradle.
Figure 15:
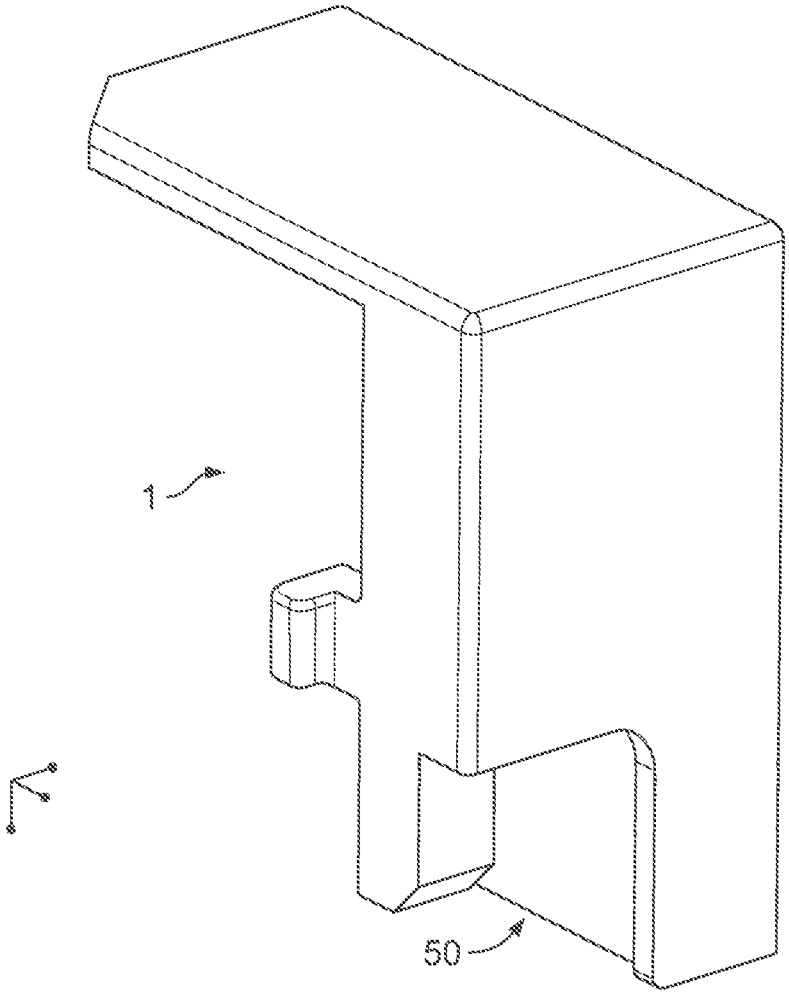
FIG. 15 is a perspective view of the cradle.
Figure 16:
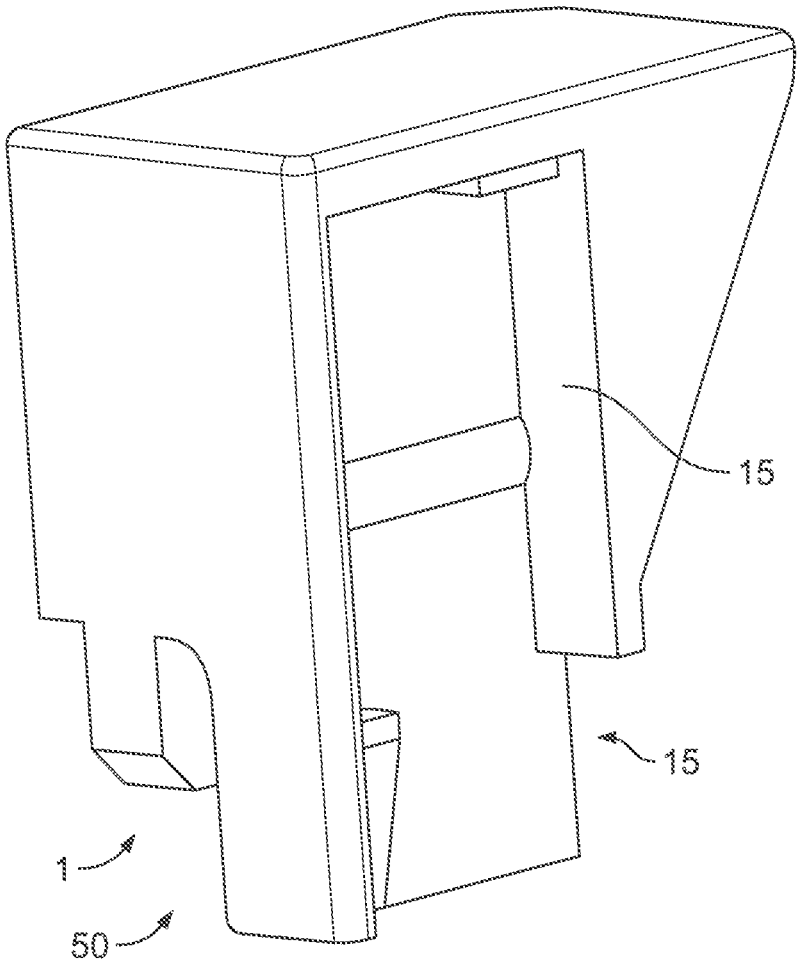
FIG. 16 is a perspective view of the cradle.

The cradle 1 has a recess 50 adjacent to the receptacle 6, as shown in FIGS. 1, 2, 3, 15, and 16. A stiffening member 51 of the base body 19 is disposed in the recess 50. As a result of this telescoping design, the relay 1 can be particularly space-saving. The cradle 1 further has a stiffening strip 52 which stabilizes the cradle 1 against twisting or bending, as shown in FIGS. 4 and 5. A reinforcing member 90 is arranged in an inner edge of the cradle 1, as shown in FIGS. 11 and 14, and permits a good flow of force.

What is claimed is:

1. A cradle for a relay, comprising:

a force introduction section at which a force is introduced from a triggering system; and a force diversion section in which the force that is introduced from the triggering system is diverted to a contact system, a direct connection line extending between the force introduction section and the force diversion section runs through a receptacle, a bottom of the receptacle is spaced apart from the direct connection line, the receptacle has a wall extending from the bottom perpendicular to the direct connection line and separating the receptacle from the contact system, the force introduction section is a leg extending from the bottom perpendicular to the direct connection line, a portion of the triggering system is positioned between the leg of the force introduction section and the wall in a direction extending parallel to the direct connection line.

2. The cradle of claim 1, wherein the receptacle forms a channel at least in sections.

3. The cradle of claim 1, wherein the receptacle has a pair of inner walls extending in a U-shape.

4. The cradle of claim 1, wherein the wall shields the contact system from the triggering system.

5. The cradle of claim 1, wherein the force introduction section and/or the force diversion section has an engagement section.

6. The cradle of claim 5, wherein the engagement section engages the triggering system or the contact system.

7. The cradle of claim 5, wherein the engagement section is configured as a hook.

8. The cradle of claim 1, further comprising an engagement projection for the triggering system and/or the contact system.

9. The cradle of claim 1, wherein the cradle forms a contact system receptacle.

10. The cradle of claim 9, wherein the contact system receptacle is formed at least in part in a U-shape.

11. The cradle of claim 7, wherein the engagement section is attached to the leg and engages in a hole in an armature of the triggering system.

12. A cradle assembly, comprising:

a cradle for a relay including a force introduction section at which a force is introduced from a triggering system and a force diversion section in which the force that is introduced from the triggering system is diverted to a contact system, a direct connection line extending between the force introduction section and the force diversion section runs through a receptacle, a bottom of the receptacle is spaced apart from the direct connection line, the receptacle has a wall extending from the bottom perpendicular to the direct connection line and separating the receptacle from the contact system, the force introduction section is a leg extending from the bottom perpendicular to the direct connection line;

a portion of the triggering system arranged between the leg of the force introduction section and the wall in a direction extending parallel to the direct connection line; and a plurality of contacts of the contact system arranged at the force diversion section.

13. The cradle assembly of claim 12, wherein an armature of the triggering system is arranged at the force introduction section, a yoke of the triggering system is the portion arranged between the leg and the wall.

14. The cradle assembly of claim 12, wherein the wall extends on each of a pair of opposite sides of the contacts.

15. A relay, comprising:

a triggering system;

a contact system;

a cradle including a force introduction section at which a force is introduced from the triggering system and a force diversion section in which the force that is introduced from the triggering system is diverted to the contact system, a direct connection line extending between the force introduction section and the force diversion section runs through a receptacle, a bottom of the receptacle is spaced apart from the direct connection line, the receptacle has a wall extending from the bottom perpendicular to the direct connection line and separating the receptacle from the contact system, the force introduction section is a leg extending from the bottom perpendicular to the direct connection line, a portion of the triggering system is positioned between the leg of the force introduction section and the wall in a direction extending parallel to the direct connection line; and a base body receiving the triggering system and the cradle, a section of the base body projecting into the receptacle.

16. The relay of claim 15, further comprising an isolation slot extending in a U-shape around the section of the base body and between the triggering system and the contact system.

17. The relay of claim 15, wherein the force introduction section is at least in part between an armature and a yoke of the triggering system.

18. The relay of claim 15, wherein the cradle has an engagement projection for the triggering system and/or the contact system.

19. The relay of claim 18, wherein the engagement projection is a hook attached to the leg of the force introduction section and engaging in a hole in an armature of the triggering system.

* * * * *